US009784054B2

(12) United States Patent
Wilson et al.

(10) Patent No.: US 9,784,054 B2
(45) Date of Patent: Oct. 10, 2017

(54) SYSTEM AND METHOD FOR ESTABLISHING TUBULAR CONNECTIONS

(71) Applicant: Tesco Corporation, Houston, TX (US)

(72) Inventors: James Tyler Wilson, Katy, TX (US); Ryan Thomas Bowley, Calgary (CA); Brent James-William Coombe, Calgary (CA); Colin Trevor Maxwell, Elnora (CA); Doug Christian Greening, Calgary (CA)

(73) Assignee: Tesco Corporation, Houston, TX (US)

( * ) Notice: Subject to any disclaimer, the term of this patent is extended or adjusted under 35 U.S.C. 154(b) by 514 days.

(21) Appl. No.: 14/444,830

(22) Filed: Jul. 28, 2014

(65) Prior Publication Data

US 2016/0024862 A1 Jan. 28, 2016

(51) Int. Cl.

| | |
|---|---|
| ***E21B 17/042*** | (2006.01) |
| ***E21B 19/16*** | (2006.01) |
| ***E21B 3/035*** | (2006.01) |

(52) U.S. Cl.

CPC ..... *E21B 19/166* (2013.01); *E21B 3/035* (2013.01); *E21B 17/042* (2013.01)

(58) Field of Classification Search

CPC ..... E21B 19/16; E21B 19/166; E21B 19/165; E21B 17/04; E21B 17/042; E21B 3/035; E21B 44/00; B67B 3/2073

See application file for complete search history.

(56) References Cited

U.S. PATENT DOCUMENTS

| | | | | |
|---|---|---|---|---|
| 3,905,427 | A | 9/1975 | Kenney | |
| 4,781,359 | A * | 11/1988 | Matus | E21B 19/16 166/77.52 |
| 6,158,196 | A * | 12/2000 | Trebbi | B67B 3/2073 53/317 |
| 6,536,520 | B1 | 3/2003 | Snider et al. | |
| 9,416,601 | B2 * | 8/2016 | Mullins | E21B 19/06 |
| 2007/0251701 | A1 | 11/2007 | Jahn et al. | |
| 2008/0093127 | A1 * | 4/2008 | Angman | E21B 19/16 175/170 |
| 2010/0314100 | A1 | 12/2010 | Tepavac et al. | |
| 2011/0083903 | A1 * | 4/2011 | Ledbetter | E21B 7/025 175/107 |

(Continued)

OTHER PUBLICATIONS

PCT International Search Report and Written Opinion dated Sep. 22, 2015.

*Primary Examiner* — Daniel P Stephenson
(74) *Attorney, Agent, or Firm* — Fletcher Yoder, P.C.

(57) ABSTRACT

A drilling system includes a multi-function sub configured to be coupled to a top drive of a drilling rig and configured to be coupled to a tubular in order to selectively transfer a torque from the top drive to the tubular. The multi-function sub includes a torque sensing component configured to measure the torque provided from the top drive to the tubular via the multi-function sub, a clutch configured to suspend a transfer of torque from the top drive to the tubular when the clutch is released, and a clutch actuator communicatively coupled to the torque sensing component and configured to release the clutch when the torque measured by the torque sensing component is greater than a threshold torque value. The multi-function sub also includes a compensator configured to enable the multi-function sub to move the tubular in an axial direction relative to the top drive.

20 Claims, 6 Drawing Sheets

(56) References Cited

U.S. PATENT DOCUMENTS

| | | | | |
|---|---|---|---|---|
| 2014/0116686 | A1* | 5/2014 | Odell, II | E21B 19/165<br>166/250.01 |
| 2014/0131052 | A1* | 5/2014 | Richardson | E21B 19/16<br>166/380 |
| 2014/0151067 | A1* | 6/2014 | Hart | E21B 19/07<br>166/381 |
| 2015/0101865 | A1* | 4/2015 | Mauldin | E21B 47/024<br>175/40 |
| 2015/0345221 | A1* | 12/2015 | Gaikwad | E21B 4/02<br>175/57 |
| 2016/0024862 | A1* | 1/2016 | Wilson | E21B 17/042<br>166/380 |

* cited by examiner

SYSTEM AND METHOD FOR ESTABLISHING TUBULAR CONNECTIONS

BACKGROUND

Embodiments of the present disclosure relate generally to the field of drilling and processing of wells. More particularly, present embodiments relate to systems and methods for establishing tubular connections on a drilling rig.

In conventional oil and gas operations, a well is typically drilled to a desired depth with a drill string, which includes drill pipe and a drilling bottom hole assembly. Once the desired depth is reached, the drill string is removed from the hole and casing is run into the vacant hole. Casing may be defined as pipe or tubular that is placed in a well to prevent the well from caving in, to contain fluids, and to assist with efficient extraction of product. Tubular may be defined as including drill pipe, casing, or any other type of substantially cylindrical component or assembly utilized in drilling or well processing operations.

In conventional operations, tubular is often lowered into the wellbore by a top drive. A top drive typically includes a quill, which is a short length of pipe that couples with the upper end of the tubular, and one or more motors configured to turn the quill. The top drive is typically suspended from a traveling block above the rig floor so that it may be raised and lowered throughout drilling operations. To establish connections between a new length of tubular and an existing string of tubular, the length of tubular is lowered onto the existing string via the top drive, and the top drive applies a torque to thread the new length of tubular onto the existing string. It is now recognized that traditional operations used to monitor and control the amount of torque applied while making these connections have certain drawbacks. For example, existing systems allow for the top drive to apply too much torque or not enough torque while forming tubular connections.

It is now recognized that there exists a need for improved systems and methods for applying a desired amount of torque while establishing tubular connections.

BRIEF DESCRIPTION

In accordance with one aspect of the present disclosure, a drilling system includes a multi-function sub configured to be coupled to a top drive of a drilling rig and configured to be coupled to a tubular in order to selectively transfer a torque from the top drive to the tubular. The multi-function sub includes a torque sensing component configured to measure the torque provided from the top drive to the tubular via the multi-function sub, a clutch configured to suspend a transfer of torque from the top drive to the tubular when the clutch is released, and a clutch actuator coupled to the torque sensing component and configured to release the clutch when the torque measured by the torque sensing component is greater than a threshold torque value. The multi-function sub also includes a compensator configured to enable movement of the tubular in an axial direction relative to the top drive.

In accordance with another aspect of the present disclosure, a drilling system includes a multi-function sub including a first portion configured to be coupled to a top drive and a second portion configured to be coupled to a tubular. The multi-function sub is configured to selectively transfer a torque from the first portion to the second portion. The multi-function sub includes a torque sensing component configured to measure a torque provided to the tubular, a clutch, a clutch actuator, and a compensator. The clutch is configured to engage the first and second portions with each other such that they rotate together about an axis and to allow the first and second portions to rotate freely relative to one another about the axis when the clutch is released. The clutch actuator coupled to the clutch and configured to release the clutch when the torque transferred from the first portion to the second portion reaches a threshold torque level. The compensator is configured to enable the first and second portions to move relative to each other along an axial direction of the axis.

Present embodiments also provide a method including transferring a torque from a rotating top drive to a tubular via a multi-function sub coupled between the top drive and the tubular. The method also includes measuring the torque transferred to the tubular via a torque sensing component disposed in the multi-function sub. In addition, the method includes actuating a clutch disposed in the multi-function sub to suspend a transfer of the torque from the rotating top drive to the tubular when the torque measured by the sensing component exceeds a torque threshold. Further, the method includes enabling the tubular to move relative to the top drive in a direction along a rotational axis of the multi-function sub via a compensator disposed in the multi-function sub.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
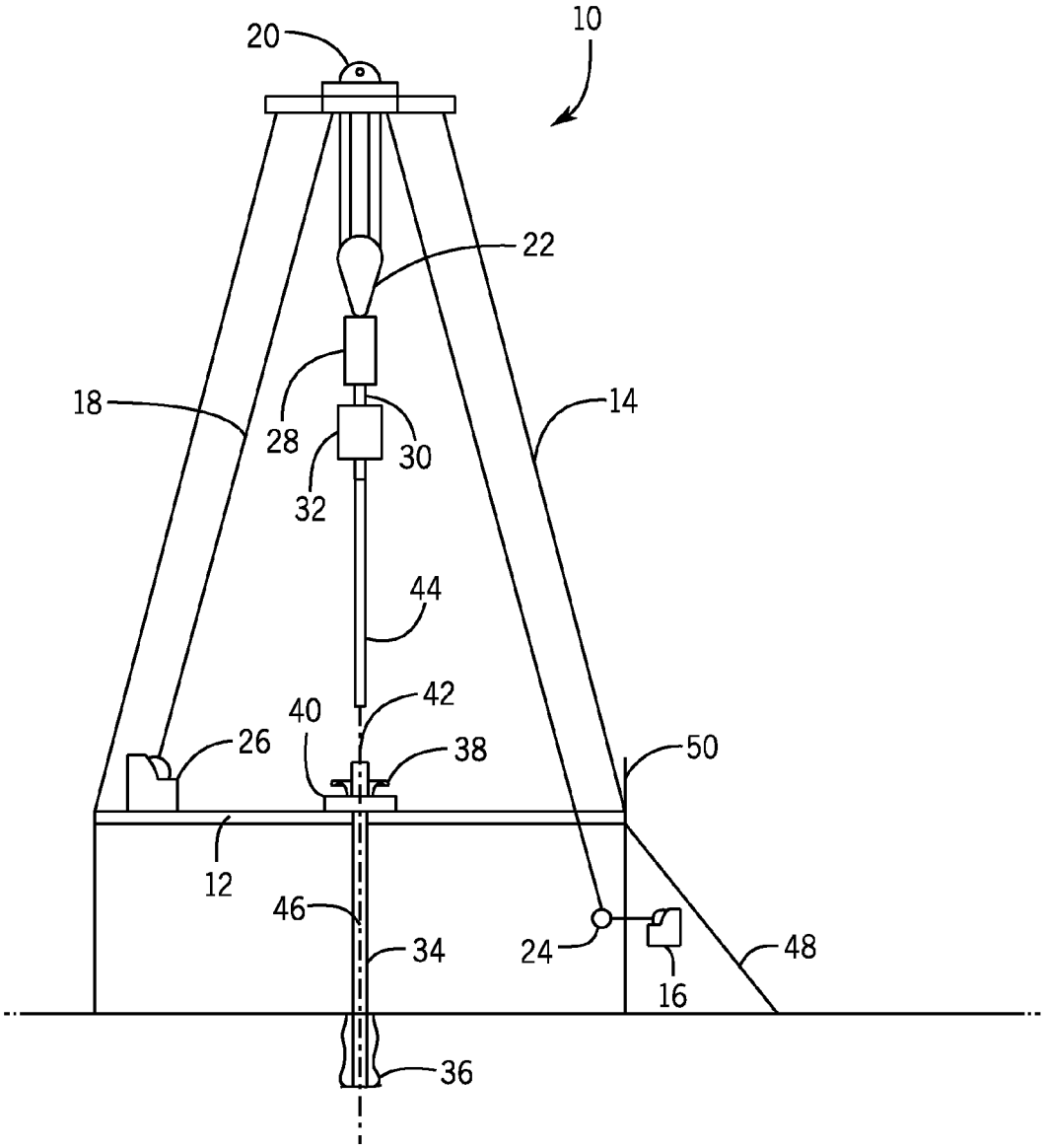
FIG. 1 is a schematic representation of a well being drilled in accordance with an embodiment of the present techniques.

Presently disclosed embodiments are directed toward systems and methods for establishing connections between tubular to form a string of tubular in drilling operations. More specifically, present embodiments are directed to a multi-function sub that may be positioned between a top drive of a drilling system and a tubular element that is being coupled to a string of tubular. The multi-function sub includes a first portion that may be coupled with the top drive and a second portion that may be coupled with the tubular element. The multi-function sub also includes a clutch that enables the selective frictional engagement of the two portions of the multi-function sub so that, when engaged, the multi-function sub can transfer torque from the rotating top drive to the tubular element.

The multi-function sub is able to control the clutch based on the amount of torque being transferred between the top drive and the tubular element at a given moment. That is, the multi-function sub may include a clutch actuator configured to release the clutch when the torque being transferred between the first and second portions reaches a threshold. When the torque reaches this threshold, the clutch actuator releases the clutch so that the portion of the multi-function sub coupled with the top drive keeps rotating without transferring rotation to the portion of the multi-function sub coupled with the tubular element. In some embodiments, the multi-function sub may include a mechanical clutch actuator that is calibrated to release the clutch via a spring or other mechanism when the torque reaches the desired threshold. Thus, the multi-function sub may automatically release the tubular element from rotation when the correct torque has been applied for making the tubular connection.

In some embodiments, the multi-function sub is able to control the clutch based on live feedback received from a torque sensing component of the multi-function sub. The torque sensing component is designed to sense a torque being applied on the tubular element connected to the multi-function sub. When the torque measured by the torque sensing component reaches a threshold, a control component of the multi-function sub releases the clutch so that the portion of the multi-function sub coupled with the top drive keeps rotating without transferring rotation to the portion of the multi-function sub coupled with the tubular element. Thus, the multi-function sub may automatically release the tubular element from rotation when the correct torque has been applied for making the tubular connection. This may prevent or reduce overtorquing of the tubular connection or undertorquing of the tubular connection.

Further still, the multi-function sub includes a compensator that enables the tubular element to move up and down in a direction along a rotational axis of the multi-function sub relative to the top drive. A tension sensing device on the multi-function sub may determine a tension force on the tubular element, and the compensator may provide a counterbalance to compensate for any sensed tension. In other embodiments, the compensator may generally add a degree of freedom of movement for the tubular element along the axial direction relative to the top drive, without providing a force for elevating the portion of the multi-function sub coupled to the tubular element. This may allow the multi-function sub to automatically prevent or reduce the application of undesirable axial loads onto the tubular components while making connections. This may keep the tubular connections from becoming damaged while being connected or lowered into a wellbore.

Turning now to the drawings, FIG. 1 is a schematic representation of a drilling rig 10 in the process of drilling a well in accordance with an embodiment of the present disclosure. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. The traveling block 22 supports a top drive 28, which features a quill 30 used to turn tubular or other drilling equipment. In the illustrated embodiment, the quill 30 is coupled to a multi-function sub 32 in accordance with present embodiments. The multi-function sub 32, as described in detail below, is configured to ensure that a desired torque is applied from the top drive 28 when establishing tubular connections. Below the rig floor 12, a tubular string 34 extends downward into a wellbore 36 and is held stationary with respect to the rig floor 12 by a spider or slips 38 of a rotary table 40. A portion of the tubular string 34 extends above the rig floor 12, forming a stump 42 to which another tubular element 44 (e.g., a joint of drillpipe or casing) is in the process of being added.

In the illustrated embodiment, the top drive 28 is hoisting the tubular element 44 to a vertically aligned position over well center. That is, the tubular element 44 is aligned with a vertical axis 46 that passes through the center of the wellbore 36. When the tubular element 44 is aligned with well center, it is also aligned with the center of the quill 30, the stump 42, and the tubular string 34 extending into the wellbore 36. From this position, the tubular element 44 can be lowered (e.g., stabbed) onto the stump 42, rotated to form the connection, and eventually lowered into the wellbore 36. Before the tubular element 44 is hoisted by the top drive 28 into alignment with well center, as shown in FIG. 1, the tubular element 44 may be transported up a pipe ramp 48 and through a V-door 50 to a position on the rig floor 12 that makes the tubular element 44 readily accessible for coupling with the top drive 28 and multi-function sub 32.

As noted above, the drilling rig 10 may be equipped with a multi-function sub 32 coupled to the top drive 28. The multi-function sub 32 is configured to be coupled with the tubular element 44 and used to apply a desired torque when connecting the tubular element 44 to the stump 42 of the tubular string 34. As illustrated, the multi-function sub 32 may be contained within a single housing. The multi-function sub 32 may provide multiple different functionalities when handling the tubular element 44 connected thereto. For example, the multi-function sub 32 may be configured to measure a torque output from the top drive 28 for rotating the tubular element 44. The multi-function sub 32 may also include a clutch that allows the top drive to rotate without transferring torque to the tubular element 44, and this clutch may be selectively actuated based on the torque measurement being taken by the multi-function sub 32. In some embodiments, the multi-function sub may include a mechanical assembly calibrated and configured to release the clutch when the desired torque is reached. Further, the multi-function sub may allow the tubular element 44 to move up and down along the axis 46 relative to the top drive 32 via a compensator or float control mechanism. These features allow for improved and controlled transfers of axial force and torque between the tubular element 44 and the stump 42 while forming tubular connections.

Although the multi-function sub 32 is described throughout this application as being coupled between the top drive 28 and the tubular element 44, it should be noted that the multi-function sub 32 may be coupled between other tools or equipment being hoisted over the rig floor 12. For example, in some embodiments, the multi-function sub 32 may be used in conjunction with a casing drive system to connect lengths of casing. In such embodiments, the multi-function sub 32 may be coupled between the quill 30 of the top drive 28 and a quill of the casing drive system, which is used to pick up the tubular element 44. Once the tubular element 44 is in place within the casing drive system, the multi-function sub 32 may be used to selectively transfer torque from the top drive 28 to the casing drive system and to float the casing drive system relative to the top drive 28. Other pieces of equipment and drilling tools may be coupled in series between the top drive 28, the multi-function sub 32, and the tubular element 44 in presently disclosed embodiments.

It should be noted that the illustration of FIG. 1 is intentionally simplified to focus on the multi-function sub 32 described in detail below. Many other components and tools may be employed during the various periods of formation and preparation of the well. In some embodiments, for example, the illustrated top drive 28 may be replaced by a swivel in a drilling rig 10 that utilizes a Kelly drive to turn the tubular string 32. Similarly, as will be appreciated by those skilled in the art, the orientation and environment of the well may vary widely depending upon the location and situation of the formations of interest. For example, rather than a generally vertical bore, the well, in practice, may include one or more deviations, including angled and horizontal runs. In addition, while shown as a surface (land-based) operation, the well may be formed in water of various depths, in which case the topside equipment may include an anchored or floating platform.

Figure 2:
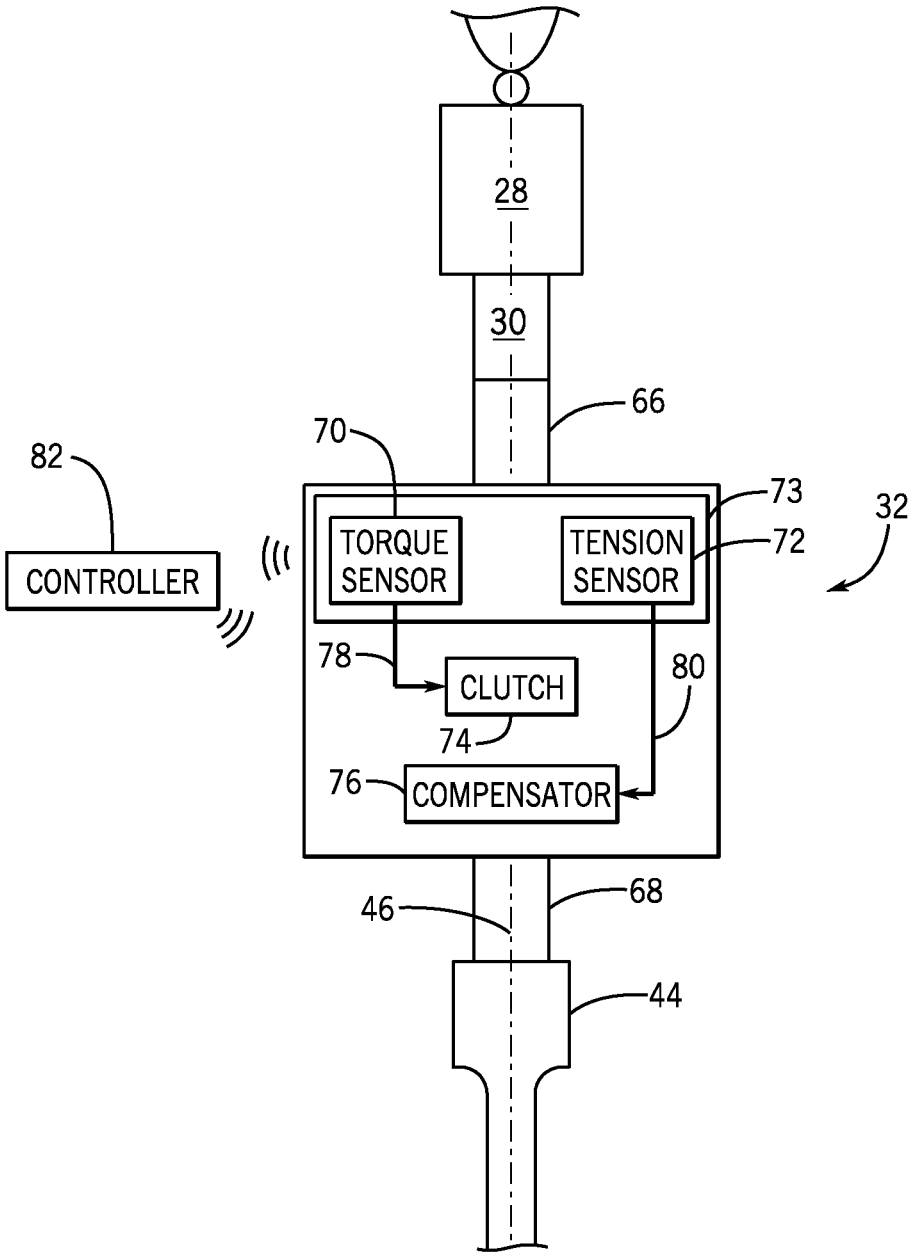
FIG. 2 is a schematic of a multi-function sub that may be used in conjunction with a top drive to establish tubular connections in accordance with an embodiment of the present techniques.

FIG. 2 is a schematic representation of an embodiment of the multi-function sub 32 illustrated in FIG. 1. As discussed above, the multi-function sub 32 is configured to be coupled to the quill 30 of the top drive 28. As the top drive 28 rotates the quill 30, a portion 66 of the multi-function sub 32 that is directly coupled to the quill 30 will rotate along with the quill 30. However, another portion 68 of the multi-function sub 32, which is coupled to the tubular element 42, may be selectively rotated along with the quill 30 and the first portion 66 of the multi-function sub 32 coupled to the quill 30. These two portions 66 and 68 may be located one inside the other, such that the entire multi-function sub 32 is a self-contained unit.

As noted above, the multi-function sub 32 includes a torque sensing device 70 that may detect a measurement of the torque being transferred from the top drive 28 through the multi-function sub 32 and to the tubular element 44 (or tubular string). Any desirable torque sensing device 70 may be used to perform this measurement.

In addition to the torque sensing device 70, other sensing components may be part of the multi-function sub 32. For example, the multi-function sub 32 may include a tension sensing device 72 used to measure an amount of tension on the multi-function sub 32 from the tubular element 44. To accomplish this, the tension sensing device 72 may detect a weight of the tubular element 44 (or tubular string 34) coupled to the multi-function sub 32. As the tubular element 44 is brought into contact and threaded engagement with the stump 42 of the tubular string 34, the weight and impact force on the multi-function sub 32 may fluctuate.

In the illustrated embodiment, the torque sensing device 70 and the tension sensing device 72 are part of a single sensing unit, such as a wireless torque turn system (WTTS) 73. However, in other embodiments, the torque sensing device 70 and the tension sensing device 72 may be located separately in the multi-function sub 32. Based on the measured torque and/or the measured tension, other components of the multi-function sub 32 may be actuated to maintain the torque and tension on the tubular element 44 within a desired range.

In addition to the sensing components, the multi-function sub 32 includes a releasable clutch 74 used to selectively engage or disengage the two portions 66 and 68 of the multi-function sub 32 (one coupled to the top drive 28 and the other coupled to the tubular element 44) from each other. The clutch 74 may be communicatively coupled with the torque sensing device 70, so that the clutch 74 is released when the torque from the top drive 28 reaches a predetermined torque threshold. That is, when the torque sensing device 70 reads the threshold torque value, the clutch 74 is released so that the portion 66 of the multi-function sub 32 coupled to the top drive 28 can rotate freely about the axis 46 without transferring any torque to the portion 68 of the multi-function sub 32 coupled to the tubular element 44.

The releasable clutch 74 allows the multi-function sub 32 to transmit torque to the tubular element 44 while making connections between the tubular element 44 and the tubular string 34 and to suspend this torque transfer when the connection reaches a desired set point. This desired torque set point or threshold may be programmed into the multi-function sub 32 (e.g., stored in a control system memory) so that when the torque sensing device 70 reads the torque set point, a signal is sent to a clutch actuator that instantaneously, or nearly instantaneously, releases the clutch 74 to suspend a transfer of torque from the top drive to the tubular element 44. This keeps the multi-function sub 32 from overtorquing (applying too much torque) or undertorquing (applying too little torque) to the tubular element 44 while making the connection. Thus, the disclosed multi-function sub 32 enables more accurate application of torque to the tubular elements 44 than would be available through a driller watching and reacting to a torque readout at the driller's panel.

It should be noted that some embodiments of the present disclosure may not include the torque sensing device 70 illustrated in FIG. 2, but may instead include a releasable clutch 74 and a mechanical clutch actuator for selectively releasing the clutch 74. For example, the mechanical clutch actuator may include a pre-loaded spring that will begin to move, releasing a hair trigger for actuating the clutch 74 when the desired torque value is reached. The mechanical clutch actuator may be calibrated to release the clutch 74 at the desired torque level. In other embodiments, the mechanical clutch actuator may be used in conjunction with the described torque sensing device 70. This may be used to aid in the calibration of the clutch actuator, or to provide live torque feedback to operators via the torque sensing device 70 while actuating the clutch 74 via the mechanical assembly. It should be noted that other types of clutch actuators may be employed in other embodiments, such as hydraulic actuators, pneumatic actuators, and so forth.

It should be noted that any number of possible clutch designs may be used to implement the clutch 74 in the disclosed embodiments. For example, as described in detail below, the clutch 74 may be a hydraulic drum clutch. In other embodiments, the clutch 74 may include a multi-plate disc clutch. In addition, some embodiments may include an electrical clutch for selectively engaging or releasing the two portions 66 and 68 of the multi-function sub 32 from one another. Still further, some embodiments of the clutch 74 may be configured as disc brakes or calipers that use a mechanical force to squeeze the two portions of the multi-function sub 32 against one another when closed. Such disc brakes or calipers may be pneumatically actuated, hydraulically actuated, or mechanically actuated (e.g., spring applied brakes).

In addition to the clutch 74, the multi-function sub 32 includes a compensator 76 that enables the tubular element 44 to move in an axial direction relative to the top drive 28. That is, the compensator 76 may allow the two portions 66 and 68 of the multi-function sub 32 to move relative to each other along the direction of the axis 46. The compensator 76 may be controlled to compensate for the tension applied axially to the tubular element 44 as it is connected to the rest of the tubular string 34. This control may be particularly desirable when making connections of casing, as described in detail below. In some embodiments, the compensator 76 may be communicatively coupled to the tension sensing device 72 of the multi-function sub 32. When the tension sensing device 72 reads a tension along the tubular exceeding a threshold value, the compensator 76 may automatically feed out the portion 68 of the multi-function sub 32 coupled to the tubular element 44 to decrease the tension while the tubular element 44 is being threaded onto the stump 42. In some embodiments, the compensator 76 may feed out the portion 68 of the multi-function sub by an amount corresponding to a value of the sensed tension. Other control regimes may be applied to ensure that the compensator 76 decreases the tension applied to the tubular element 44.

In addition, the compensator 76 may, in some embodiments, be counterbalanced to account for the weight of the tubular element 44 being supported by the multi-function sub 32. That is, the compensator 76 may apply a force to the portion 68 of the multi-function sub coupled to the tubular element 44 to counter the weight of the tubular element 44. This force (or pressure) may be applied pneumatically, for example. This allows the tubular element 44 to float in a weightless or nearly weightless manner while being assembled to the rest of the tubular string 34. This may limit the amount of force applied directly to a top of the stump 42 at impact when the tubular element 44 is lowered onto the stump 42. The compensator 76 may be configured such that the pressure applied therefrom may be dialed up or down in order to maintain a desired counter balance of the weight of the tubular element 44 and any other tools beneath the compensator 76.

The compensator 76 may add an axial degree of freedom along the axis 46 when connecting the tubular element 44 to the stump 42. As discussed above, this connection is a threaded connection between threads on the tubular element 44 and corresponding threads on the stump 42. In certain contexts, particularly when connecting a string of casing elements, it is desirable for the connection to be made without applying a large axial load (e.g., in a direction of the axis 46) to the threads of the casing string. This is because the casing string, once lowered into the wellbore 36, typically will remain in the wellbore 36 for a long period of time while product is removed from the well. Applying large axial loads to the threads while making connections may weaken the threaded connections between the lengths of casing, thereby leading to leaks and inefficient operation of the casing.

The compensator may reduce or eliminate such axial loads applied between threads of the tubular element 44 and the stump 42. As the top drive 28 and multi-function sub 32 lower the tubular element 44 onto the stump 42 and apply a torque to the tubular element 44, the threads on the tubular element 44 are urged into further engagement with the threads of the stump 42. This causes axial movements of the tubular element 44 relative to the stationary stump 42, therefore applying a force between the two components. When these axial forces on the tubular element 44 are detected via the tension sensing device 72, the compensator 76 may feed out more of the portion 68 coupled to the tubular element 44. If a compressive force on the tubular element 44 is sensed via the tension sensing device 72, the compensator may feed back in the portion 68, in order to reduce the amount of force being transferred between the threads of the tubular element 44 and the stump 42.

It should be noted that some embodiments of the multi-function sub 32 may include the compensator 76 in a configuration that enables the above described axial degree of freedom without actively controlling the axial positions of the portions 66 and 68 relative to one another. That is, the compensator 76 may simply be the configuration of the first portion 66 and second portion 68 relative to each other. These portions 66 and 68 may be arranged in a way that allows them to slide freely past each other in the axial direction while remaining within the multi-function sub 32. Thus, the multi-function sub 32 may automatically compensate for contact forces and impacts made in the axial direction by allowing the tubular element 44 to move upward or downward relative to the top drive 28 as the connection is formed. In such embodiments, it may not be necessary to include the tension sensing device 72 for actively controlling the compensator 76. However, it may still be desirable to monitor the tension on the tubular element 44 via the tension sensing device 72 even while using a passive compensator 76. In addition, the tension sensing device 72 may be used to calibrate the compensator 76, in order to provide a cushion to compensate for the initial weight of the tubular element 44 prior to making the connection.

As mentioned above, the multi-function sub 32 may include the sensing devices 70 and 72, the clutch 74, and the compensator 76 all within a single seamless tool. That is, the multi-function sub 32 may provide sensing, selective clutch actuation, and thread compensation all within a single integrated system. This integral construction of the multi-function sub 32 enables a streamlined system for making tubular connections without applying undesirable forces or torques to the connected components. The compensator 76 prevents or reduces excess forces applied in the axial direction when making connections, while the clutch 74 prevents or reduces excess or inadequate application of torque to the connection. By applying the desired amount of torque and limiting the axial loads applied to the connection, the multi-function sub 32 may prevent or reduce damaged connections that could lead to equipment damage, as well as expensive and time-consuming recovery efforts once casing is laid in the wellbore 36.

The multi-function sub 32 may make tubular connections more efficiently than would be possible using existing systems. For example, existing systems may involve the use of a driller manually watching the torque value being applied by the top drive, or the top drive 28 may be equipped with a component that releases a pressure on the top drive 28 when a desired torque is reached. Either way, when a certain torque is reached, power tongs are positioned over the tubular element 44 and the stump 42 and are used to complete the fully torqued connection. Thus, the top drive 28 and a separate pair of power tongs are generally used to make connections. Switching between these components takes a considerable amount of time and effort. However, the presently disclosed multi-function sub 32 is a single system that automatically torques the tubular element 44 into connection with the tubular string 34 while compensating for the threaded connection. The disclosed multi-function sub 32 is able to complete connections without the use of additional power tongs, thereby increasing the efficiency of the connection process as compared to existing systems.

As discussed above, the multi-function sub 32 may control the clutch 74 and the compensator 76 based upon the sensed torque and tension values detected by the torque sensing device 70 and the tension sensing device 72, respectively. To that end, the multi-function sub 32 may include a control system configured to interpret signals received from the torque sensing device 70 and from the tension sensing device 72 and to output control signals to the clutch 74 and the compensator 76 in response to the measured torque and tension values. Thus, the multi-function sub 32 operates based on live feedback controls. The sensing devices 70 and 72 are not passive sensing devices, but instead are used by the control system to actively control the clutch 74 and the compensator 76. This enables more accurate and repeatable operations of the multi-function sub 32 while making tubular connections, as compared to a drilling operator controlling the torque based on a readout or completing a connection using power tongs.

In some embodiments, the control system may be disposed within the multi-function sub 32, making the controls of the multi-function sub 32 part of an entirely self-contained apparatus. For example, the WTTS 73 that includes the sensing devices 70 and 72 may be a control system that interprets signals from the sensing devices 70 and 72 and outputs control signals 78 and 80 to the clutch 74 and the compensator 76, respectively. It should be noted that the controls signals 78 and 80 may be hydraulic fluid signals that actuate a hydraulic clutch 74 and/or hydraulic compensator 76.

In other embodiments, the torque sensing device 70 and the tension sensing device 72 may communicate the measured values to an external controller 82, which sends control signals back to the multi-function sub 32 for controlling the clutch 74 and compensator 76 based on the feedback from the sensing devices 70 and 72. In the illustrated embodiment, the external controller 82 communicates wirelessly with the different control and monitoring components of the multi-function sub 32. In other embodiments, however, the external controller 82 may be coupled to the various components of the multi-function sub 32 via wired connections. It should be noted that the external controller 82 may include or may be located at a driller's panel or similar operator interface at the rig floor 12. This may allow the external controller 82 to output a user viewable display of the measured torque and/or tension values from the multi-function sub 32 on a user interface and to provide control signals to the clutch 74 and the compensator 76.

In still further embodiments, the multi-function sub 32 may include a hard-wired controller (e.g., WTTS 73) disposed within the multi-function sub 32 in addition to the external controller 82. This may allow the multi-function sub 32 to perform the bulk of the live feedback control operations onboard the multi-function sub 32, while the external controller 82 provides alerts, visual displays, and override control functionality to operators at the rig floor 12. In another embodiment, the external controller 82 may analyze the signals from the torque sensing device 70 and the tension sensing device 72 and signal the onboard WTTS 73 to output hydraulic signals for actuating or resetting the clutch 74 and the compensator 76.

It should be noted that the control components may be used in some embodiments of the multi-function sub 32 for monitoring torque and tension measurements but not for directly controlling the clutch 74 and the compensator 76. Instead, the clutch 74 may be actuated via a mechanical assembly that is calibrated to automatically release the clutch 74 when the torque on the tubular element 44 reaches a desired value. Further, the compensator 76 may provide an axial degree of freedom, without actively adjusting the position of the first and second portions 66 and 68 based on a measured tension. In further embodiments, the multi-function sub 32 may not contain any control components (e.g., WTTS 73, torque sensing device 70, tension sensing device 72, external controller 82), but rely instead on previously calibrated mechanical, pneumatic, and hydraulic actuating components to release the clutch 74 and provide the axial degree of freedom of the compensator 76.

Having now discussed the general components of the multi-function sub 32 and the functions performed by these components, more detailed examples of the multi-function sub 32 will be described. Each of the following FIGS. 3-5 include the basic components described above with reference to FIG. 2, but these components are arranged differently or may include different types of clutch actuation mechanisms.

Figure 3:
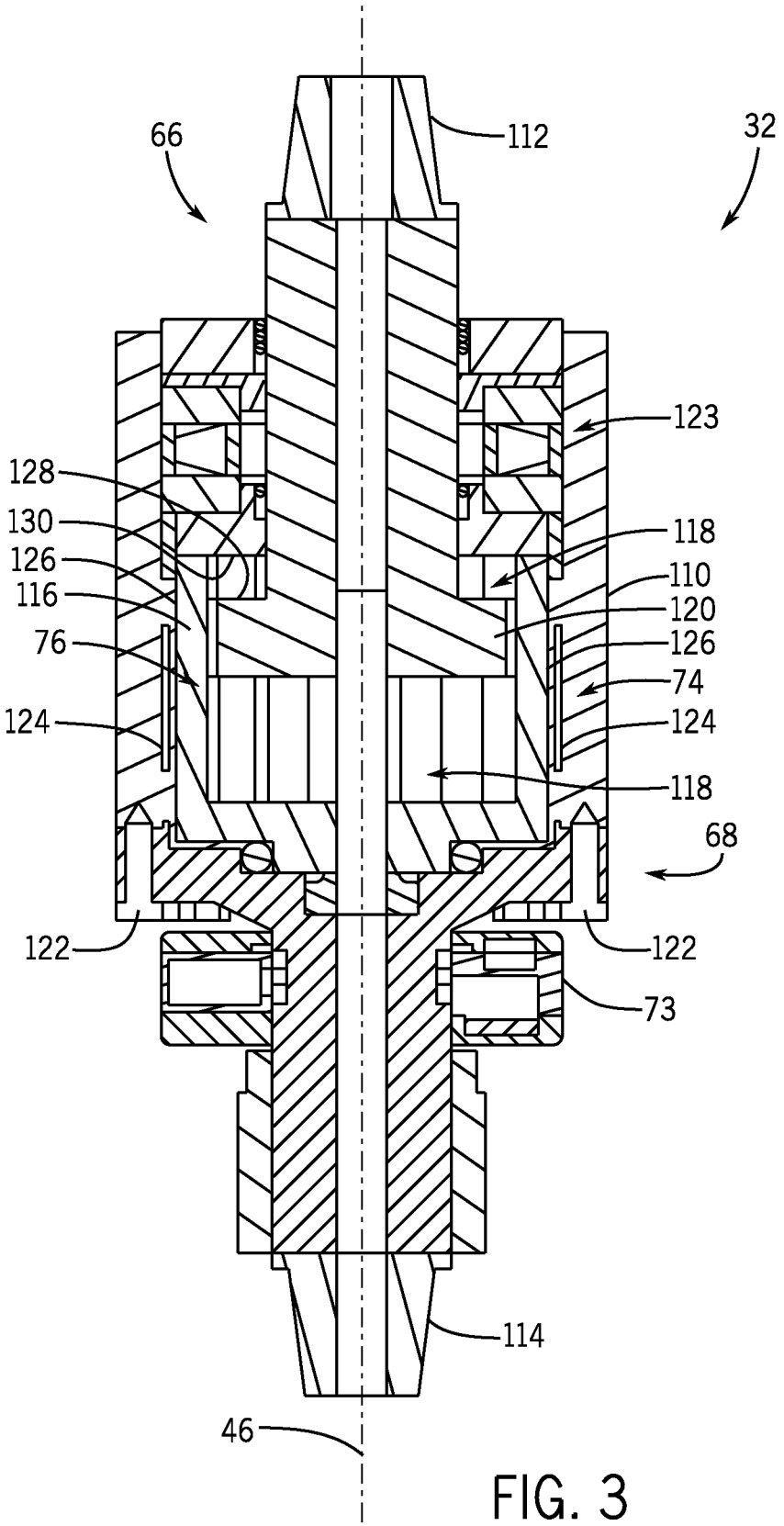
FIG. 3 is a cross sectional view of the multi-function sub of FIG. 2 having a drum clutch, in accordance with an embodiment of the present techniques.

FIG. 3 is a cross sectional view of one embodiment of the multi-function sub 32 introduced in FIGS. 1 and 2. As discussed above, the WTTS 73 may include both of the sensing devices 70 and 72. In the illustrated embodiment, the WTTS 73 is disposed below the other components of the multi-function sub 32. It should be recognized, however, that the WTTS 73 may be located at the top of the multi-function sub 32 in other embodiments. In the illustrated embodiment, the WTTS 73 may be fully integrated into the rest of the multi-function sub 32. However, in other embodiments, the WTTS 73 may be a separate component that is threaded onto the other components of the multi-function sub 32.

The multi-function sub 32 may include a housing 110, a quill 112 extending upward from the housing 110, another quill 114 extending downward from the housing 110, a chamber housing 116 disposed within the housing 110 to define a hydraulic chamber 118, and a piston 120 disposed within the chamber 118. In the illustrated embodiment, the upward extending quill 112 is directly coupled to the piston 120 and movably coupled to the chamber housing 116. These components together form the portion 66 of the multi-function sub 32 configured to be coupled with the top drive 28. The quill 112 may be coupled with the quill 30 of the top drive 28 via a direct coupling or using some intermediate component threaded between the two quills 30 and 112. As illustrated, the quill 112 and the piston 120 may be integral with each other, and formed from a single piece of material. In other embodiments, the quill 112 and piston 120 may be coupled together via fasteners. The quill 112 may be coupled to the chamber housing 116 via bearings. As discussed in detail below, the piston 120 may be able to move in a direction along the axis 46 relative to the chamber housing 116, in order to perform the functions of the compensator 76.

In the illustrated embodiment, the downward extending quill 114 is structurally coupled to the housing 110, and these pieces together form the portion 68 of the multi-function sub 32 configured to be coupled with the tubular element 44. The quill 114 may be coupled with the tubular element 44 via a direct coupling or using some intermediate component threaded between the quill 114 and the tubular element 44. The quill 114 and the housing 110 may be two separate pieces that are coupled together via fasteners 122, as illustrated. In other embodiments, the quill 114 and the housing 110 may be integral with each other, formed from a single piece of material.

As discussed above, the multi-function sub 32 includes the clutch 74 to enable selective engagement and disengagement between the portions 66 and 68 of the multi-function sub 32. In the illustrated embodiment, the clutch 74 enables engagement and disengagement between an outer surface of the chamber housing 116 and an inner surface of the housing 110. When the top drive 28 rotates the quill 30, the upward extending quill 112, piston 120, and chamber housing 116 will rotate along with the quill 30. When the clutch 74 is actuated to engage the chamber housing 116 with the housing 110 of the multi-function sub 32, the housing 110 will rotate along with the rotating chamber housing 116, thereby rotating the downward extending quill 114. Thus, when the clutch 74 is actuated in this manner, the rotation from the top drive 28 will be transferred through the multi-function sub 32 to the tubular element 44.

When the clutch 74 is released based on the torque reading by the WTTS 73, the clutch 74 disengages the chamber housing 116 from the housing 110 so that the housing 110 will no longer rotate along with the rotating chamber housing 116. Instead, the chamber housing 116 will rotate with respect to the housing 110, not transferring undesirable torque to the housing 110, quill 114, and attached tubular element 44. Thus, when the clutch 74 is released in this manner, the rotation from the top drive 28 will not be transferred through the multi-function sub 32 to the tubular element 44. The multi-function sub 32 may include one or more bearing assemblies 123 designed to support the rotating components (e.g., quill 112) against the non-rotating components (e.g., housing 110) while allowing the rotating components to rotate relative to the non-rotating components without transferring torque.

In the illustrated embodiment, the clutch 74 is a hydraulic drum clutch configured to selectively engage or release the housing 110 from the rotating chamber housing 116. The hydraulic drum clutch utilizes hydraulic tubes 124 disposed in the housing 110. Upon receiving a signal from the WTTS 73 or external controller 82, a hydraulic drum actuator (e.g., piston) may push hydraulic fluid or pressurized air into the hydraulic tubes 124. This hydraulic fluid or air may expand the hydraulic tubes 124, which apply a force against a pressure plate 126 of the housing 110. As the pressure or amount of hydraulic fluid increases within the hydraulic tubes 124, the hydraulic tubes 124 may push the pressure plate 126 into engaging contact with the chamber housing 116, thereby engaging the housing 110 with the chamber housing 116.

When the clutch 74 is released, the hydraulic fluid is removed from the hydraulic tubes 124 via the hydraulic drum actuator. As the hydraulic fluid exits the hydraulic tubes 124, the pressure on the pressure plate 126 is reduced, thereby moving the pressure plate 126 away from and out of engagement with the chamber housing 116. The process of actuating and releasing the clutch 74 in the manner described above may be relatively quick, since it relies on hydraulic control provided based on live feedback data. This enables relatively accurate timing of the clutch release when the desired torque threshold is reached.

In addition to using hydraulic controls for the clutch 74, the illustrated multi-function sub 32 uses hydraulic controls for the compensator 76. The compensator 76 may include, for example, the piston 120 disposed in the chamber 118 formed by the chamber housing 116. Hydraulic or pneumatic actuators in the multi-function sub 32 may provide hydraulic fluid or pressurized air to an upper portion of the chamber 118 above the piston 120, thereby keeping an upper surface 128 of the piston 120 from contacting an upper inside surface 130 of the chamber housing 118. The pressurized fluid or air in the chamber 118 provides a cushion that keeps the portion 68 (e.g., housing 110 and quill 114) at a desired position along the axis 46 relative to the portion 66 (e.g., quill 112, piston 120, and chamber housing 116). The hydraulic or pneumatic actuators may be regulated to provide hydraulic fluid or air to the chamber 118 at a pressure that approximately balances the weight of the tubular element 44 coupled to the quill 114. The pressure applied by these actuators may be dialed up or down in order to maintain the desired counterbalance of the weight being applied thereto. As the weight of the tubular element 44 applies a downward force to the quill 114 and consequently the housing 110, the WTTS 73 or the external controller 82 signal the hydraulic or pneumatic actuators to provide hydraulic fluid or pressurized air into the chamber 118 at a desired pressure to effectively float the housing 110, quill 114, and tubular element 44 relative to the quill 112 and piston 120. Thus, the compensator 76 provides float control to compensate for the weight of the tubular element 44.

The WTTS 73 or external controller 82 may provide signals to the hydraulic actuators to adjust the pressure of hydraulic fluid or pressurized air in the chamber 118 above the piston 120 based on the detected tension on the tubular element 44 being held by the multi-function sub 32. For example, as the tubular element 44 is brought into contact with the stump 42, the tension sensing device 72 may measure a decreased tension force on the tubular element 44 upon impact with the stump 42. In response, the WTTS 73 or external controller 82 may signal the hydraulic actuators of the compensator 76 to increase the pressure in the upper portion of the chamber 118, decrease a pressure in the lower portion of the chamber 118 below the piston 120, or a combination thereof. As a result, the portion 68 of the multi-function sub 32 is moved in upward direction along the axis 46 relative to the portion 66 of the multi-function sub 32. This may decrease the amount of downward axial movement transferred from the top drive 28 to the tubular element 44, effectively dampening the motion of the tubular element 44 and reducing the axial loads applied between the tubular element 44 and the stump 42.

If the tension sensing device 72 of the WTTS 73 measures an increased tension on the tubular element 44, the WTTS 73 or external controller 82 may signal the hydraulic actuators of the compensator 76 to decrease the pressure in the upper portion of the chamber 118, increase the pressure in the lower portion of the chamber 118, or both. This may lower the portion 68 of the multi-function sub 32 relative to the portion 66 of the multi-function sub 32, extending the quill 114 coupled to the tubular 44 in the axial direction further from the quill 112 coupled to the top drive 28. Feeding the tubular element 44 out in this manner may compensate for any added tension applied to the tubular element 44 while making or breaking connections.

Figure 4:
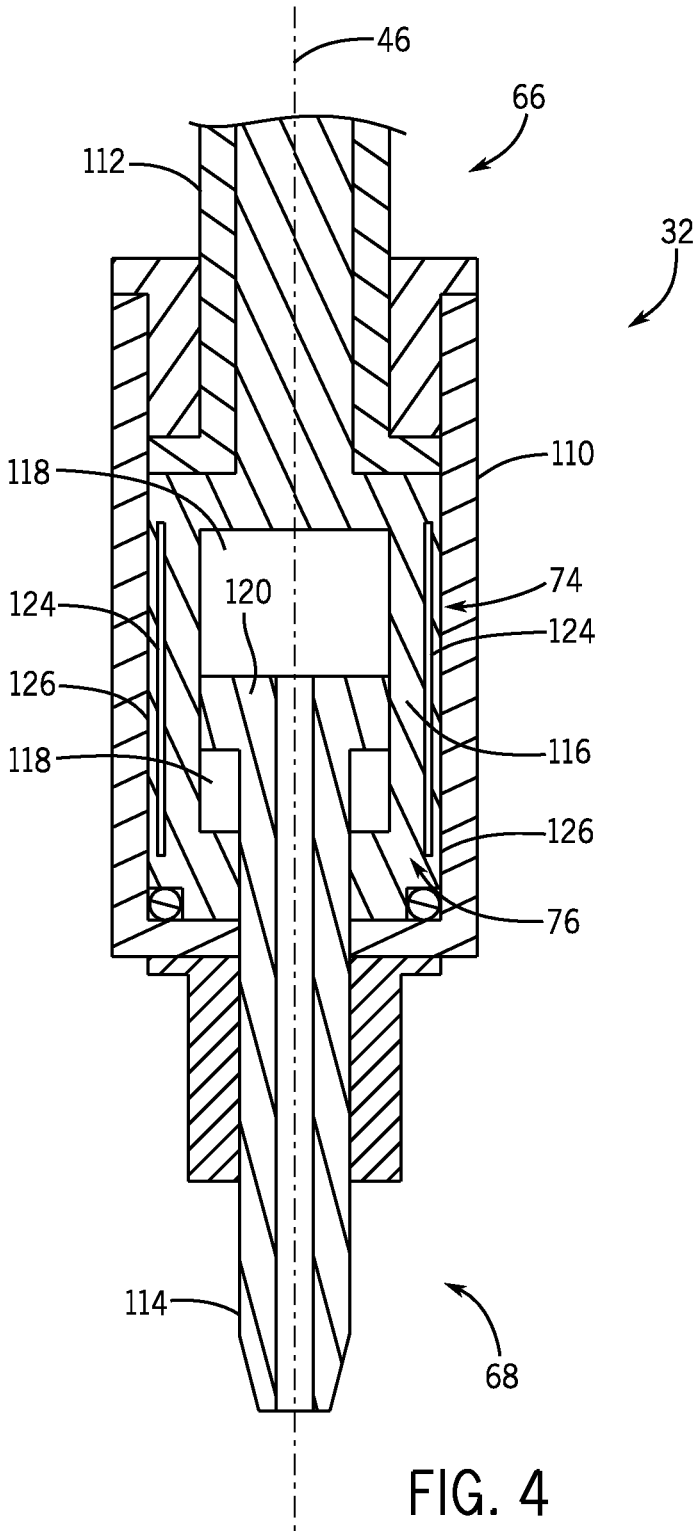
FIG. 4 is a cross sectional view of the multi-function sub of FIG. 2 having a drum clutch, in accordance with an embodiment of the present techniques.

It should be noted that several other embodiments of the multi-function sub 32 may be used to provide increased control of axial loads and torque application while connecting tubular. For example, the elements illustrated in FIG. 3 may be arranged differently in other embodiments. FIG. 4 is a cross sectional view of one such embodiment of the multi-function sub 32, which includes a hydraulic drum clutch 74 and hydraulic piston compensator 76. In the illustrated embodiment, the quill 112 and the housing 110 form the portion 66 of the multi-function sub 32 configured to be coupled to the top drive 28. In addition, the illustrated quill 114, the piston 120, and the chamber housing 116 form the portion 68 of the multi-function sub 32 configured to be coupled to the tubular element 44. Thus, the top drive 28 may rotate the housing 110, and the chamber housing 116 and the piston 120 may rotate with the housing 110 when the clutch 74 is actuated to place these components in engagement with one another.

FIG. 3 illustrated the hydraulic drum clutch as having hydraulic tubes 124 disposed in the housing 110 and configured to push the pressure plate 126 of the housing 110 into contact with the chamber housing 116. However, in other embodiments, such as shown in FIG. 4, the hydraulic drum clutch may include hydraulic tubes 124 disposed in the chamber housing 116 and configured to push the pressure plate 126 of the chamber housing 116 into contact with the housing 110.

In addition, the compensator 76 may include different structural arrangements in different embodiments. Since the piston 120 in FIG. 4 is coupled to the quill 114, the weight of the tubular element 44 applies a downward force directly to the piston 120, instead of to the housing 110 as discussed above with reference to FIG. 3. In FIG. 4, the hydraulic actuators of the compensator 76 maintain hydraulic fluid or pressurized air in the portion of the chamber 118 below the piston 120, in order to compensate for the weight of the tubular element 44. When the tension sensing device 72 measures an increased tension on the tubular element 44, the WTTS 73 or external controller 82 may control the hydraulic actuators of the compensator 76 to decrease the pressure at the lower portion of the chamber 118, increase the pressure at the upper portion of the chamber 118, or both. This feeds the quill 114 out further in the axial direction from the multi-function sub 32, thereby alleviating some of the tension on the tubular element 44.

When the tension sensing device 72 measures a decreased tension on the tubular element 44, the WTTS 73 or external controller 82 may control the hydraulic actuators of the compensator 76 to increase the pressure at the lower portion of the chamber 118, decrease the pressure at the upper portion of the chamber 118, or both. This may draw the quill 114 further into the housing 110 of the multi-function sub 32 in the axial direction, decreasing any compressive axial forces experienced by the tubular element 44.

Still further, other embodiments of the multi-function sub 32 may utilize different types of compensators 76 than those illustrated herein. For example, in some embodiments, the compensator 76 of the multi-function sub 32 may include a mechanical spring that helps to balance and counteract undesirable axial forces that are applied to the tubular element 44 in the direction of the axis 46. It should be noted that any other desirable compensator 76 may be used to provide float control for the tubular element 44 being hoisted or connected by the multi-function sub 32.

Figure 5:
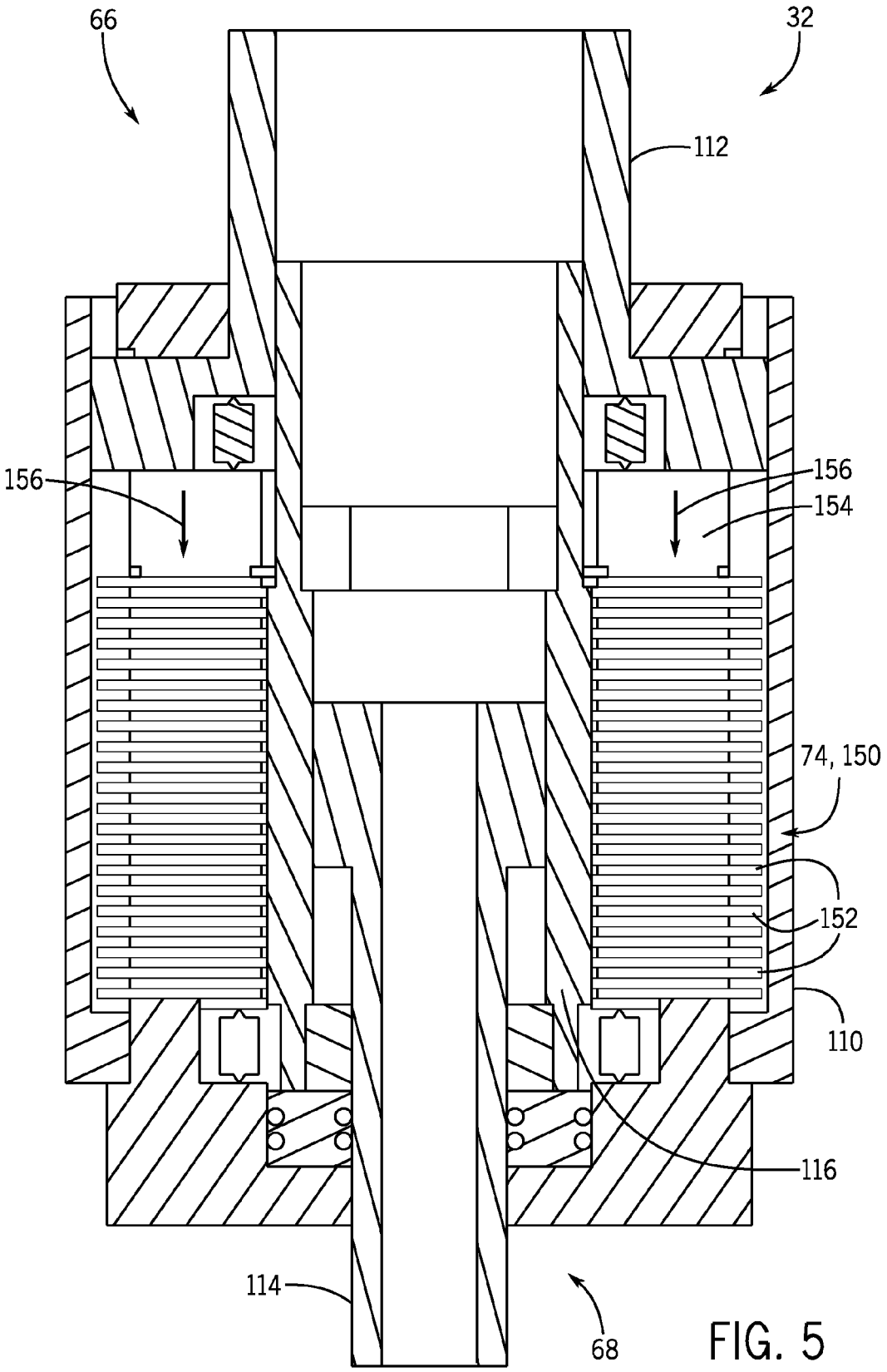
FIG. 5 is a cross sectional view of the multi-function sub of FIG. 2 having a multi-plate disc clutch, in accordance with an embodiment of the present techniques.

Different types of clutches 74 may also be used in other embodiments to selectively engage and disengage the portions 66 and 68 from each other based on the measured torque. For example, FIG. 5 illustrates an embodiment of the multi-function sub 32 that utilizes a multi-plate disc clutch 150. The multi-plate disc clutch 150 includes multiple plates 152 disposed between the housing 110 and the chamber housing 116. A group of the plates 152 are coupled at one end to the housing 110 and extend radially inward toward the chamber housing 116. Another group of the plates 152 are coupled at one end to the chamber housing 116 and extend radially outward toward the housing 110. These two different groups of plates 152 may be arranged in an alternating fashion between the housing 110 and the chamber housing 116.

In the illustrated embodiment, the multi-function sub 32 includes a hydraulic cylinder 154 for actuating and releasing the multi-plate disc clutch 150. When making tubular connections, the hydraulic cylinder 154 is pressed downward toward the plates 152, as shown by arrows 156. The hydraulic cylinder 154 may compress the plates 152 together so that they contact one another and engage the housing 110 with the chamber housing 116. As discussed above, engaging the housing 110 with the chamber housing 116 in this manner facilitates an engagement between the portion 66 of the multi-function sub 32 coupled to the top drive 28 and the portion 68 of the multi-function sub 32 coupled to the tubular element 44.

When the torque measured by the torque sensing device 70 exceeds a threshold torque value, the WTTS 73 or external controller 82 may control the actuation of the hydraulic cylinder 154 away from the plates 152. This releases the plates 152 from engagement with one another, so that the multi-function sub 32 no longer transfers torque from the portion 66 coupled to the top drive 28 to the portion 68 coupled to the tubular element 44.

It should be noted that other types of clutches 74 and clutch actuation mechanisms may be used in different embodiments of the multi-function sub 32, other than those discussed in detail herein. For example, the multi-function sub 32 may utilize a hydraulic rotary actuator, electric motor, or pre-loaded spring to engage or disengage rotating components of the multi-function sub 32 from one another.

Figure 6:
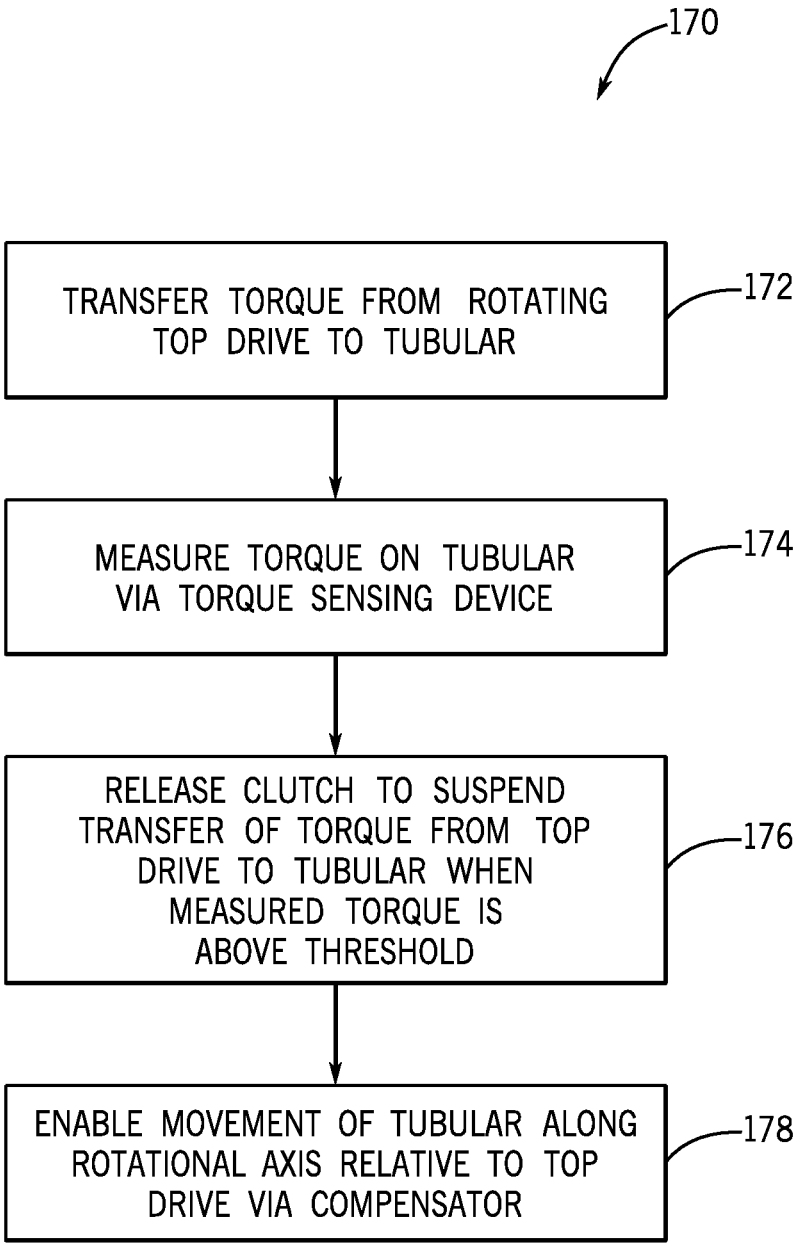
FIG. 6 is a process flow diagram of a method for establishing connections between tubular using the multi-function sub of FIG. 2, in accordance with an embodiment of the present techniques.

FIG. 6 is a process flow diagram illustrating a method 170 outlining the operation of the multi-function sub 32 disclosed herein. The method 170 includes transferring (block 172) a torque from the rotating top drive 28 to the tubular element 44 via the multi-function sub 32. This involves engaging the two portions 66 and 68 of the multi-function sub 32 via the clutch 74 in order to transfer the rotation from the top drive 28 coupled to the portion 66 to the tubular element 44 coupled to the portion 68. The method 170 also includes measuring (block 174) the torque on the tubular element 44 via the torque sensing device 70 of the multi-function sub 32. The measured torque may then be provided to a control or monitoring system, such as the WTTS 73 or the external controller 82.

The method 170 includes releasing (block 176) the clutch 74 to suspend a transfer of torque from the top drive 28 to the tubular element 44 when the measured torque is above a predetermined threshold. As discussed above, this may involve the control system comparing the measured torque to a threshold stored in memory and, when the measured torque exceeds this threshold, sending a control signal to release the clutch 74 so that the portions 66 and 68 of the multi-function sub 32 are no longer in a frictional engagement. This may suspend the transfer of torque from the top drive 28 to the tubular element 44 by allowing the portion 66 of the multi-function sub 32 coupled to the top drive 28 to rotate about the axis 46 without rotating the portion 68 of the multi-function sub 32 coupled to the tubular element 44.

Further, the method 170 includes enabling (block 178) movement of the tubular element 44 up and down in a direction along the rotational axis 46 relative to the top drive 28 via the compensator 76. As discussed above, this may involve providing hydraulic fluid or pressurized air into the chamber 118 to hold the piston 120 in a floating position within the chamber 118. A hydraulic actuation system may adjust the pressure of the fluid or air provided to the chamber 118 in response to a sensed tension applied to the tubular element 44. As tension measured by the tension sensing device 72 increases or decreases, the pressure of hydraulic fluid or air in the chamber 118 may be adjusted to move the tubular element 44 up or down relative to the top drive 28, thereby compensating for the force on the tubular element 44.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The invention claimed is:

1. A drilling system, comprising:

a multi-function sub configured to be coupled to a top drive of a drilling rig and configured to be coupled to a tubular in order to selectively transfer a torque from the top drive to the tubular, wherein the multi-function sub comprises:

a torque sensing component configured to measure the torque provided from the top drive to the tubular via the multi-function sub;

a clutch configured to suspend a transfer of torque from the top drive to the tubular when the clutch is released;

a clutch actuator coupled to the torque sensing component and configured to release the clutch when the torque measured by the torque sensing component is greater than a threshold torque value;

a compensator configured to enable movement of the tubular in an axial direction relative to the top drive; and a housing having the clutch and the compensator disposed therein.

2. The drilling system of claim 1, wherein the multi-function sub comprises a first portion configured to be coupled to the top drive and a second portion configured to be coupled to the tubular, wherein the first and second portions are configured to rotate together when the clutch engages the first and second portions with each other, and wherein the compensator is configured to enable the first and second portions to move in the axial direction relative to each other.

3. The drilling system of claim 2, wherein the torque sensing component is a separate component threaded into engagement with at least one of the first and second portions of the multi-function sub.

4. The drilling system of claim 2, wherein the torque sensing component is integral with at least one of the first and second portions of the multi-function sub.

5. The drilling system of claim 1, wherein the clutch actuator comprises a spring configured to release when the torque provided from the top drive to the tubular is greater than the threshold torque value.

6. The drilling system of claim 1, wherein the clutch comprises a hydraulic drum clutch.

7. The drilling system of claim 1, wherein the clutch comprises a multi-plate disc clutch.

8. The drilling system of claim 1, wherein the clutch comprises an electrical clutch.

9. The drilling system of claim 1, wherein the clutch comprises a disc brake or caliper clutch, wherein the clutch is hydraulically actuated, pneumatically actuated, or mechanically actuated.

10. The drilling system of claim 1, wherein the compensator comprises a hydraulic chamber and a piston disposed in the hydraulic chamber, wherein a position of the piston within the hydraulic chamber corresponds with a position of the tubular relative to the top drive along the axial direction.

11. The drilling system of claim 1, wherein the multi-function sub comprises a tension sensing component configured to measure a tension force on the multi-function sub, wherein the compensator is communicatively coupled to the tension sensing component and is configured to enable movement of the tubular in the axial direction relative to the top drive based on the tension measured by the tension sensing component.

12. The drilling system of claim 11, comprising a control component configured to:

receive a signal indicative of the measured torque from the torque sensing component;

receive a signal indicative of the measured tension from the tension sensing component; and output control signals to the clutch actuator and to the compensator based on the signals indicative of the measured torque and measured tension.

13. The drilling system of claim 12, wherein the control component is external to the multi-function sub and is configured to communicate wirelessly with the multi-function sub.

14. A drilling system, comprising:

a multi-function sub comprising:

a housing;

a first portion configured to be coupled to a top drive and a second portion configured to be coupled to a tubular, wherein the multi-function sub is configured to selectively transfer a torque from the first portion to the second portion;

a clutch disposed in the housing and configured to engage the first and second portions with each other such that they rotate together about an axis and to allow the first and second portions to rotate freely relative to one another about the axis when the clutch is released;

a clutch actuator coupled to the clutch and configured to release the clutch when the torque transferred from the first portion to the second portion reaches a threshold torque level; and a compensator disposed in the housing and configured to enable the first and second portions to move relative to each other along an axial direction of the axis.

15. The drilling system of claim 14, wherein the clutch actuator comprises a spring set to release when the torque transferred from the first portion to the second portion is greater than the threshold torque level.

16. The drilling system of claim 14, wherein the multi-function sub comprises a torque sensing component configured to measure the torque transferred from the first portion to the second portion, wherein the clutch actuator is communicatively coupled between the torque sensing component and the clutch and configured to release the clutch when the torque measured by the torque sensing component reaches the threshold level.

17. The drilling system of claim 14, wherein the compensator comprises a hydraulic chamber and a piston disposed in the hydraulic chamber, and wherein the clutch is configured to selectively engage or disengage an outer surface of the compensator from an inner surface of the housing.

18. The drilling system of claim 17, wherein the first portion comprises the housing and the second portion comprises the compensator and a quill extending downward from the piston.

19. The drilling system of claim 17, wherein the first portion comprises the compensator and a quill extending upward from the piston and the second portion comprises the housing.

20. A method, comprising:

transferring a torque from a rotating top drive to a tubular via a multi-function sub coupled between the top drive and the tubular;

measuring the torque transferred to the tubular via a torque sensing component disposed in the multi-function sub;

determining that the torque measured by the torque sensing component is greater than a torque threshold;

based on the determination that the torque measured by the torque sensing component is greater than the torque threshold, releasing a clutch of the multi-function sub such that a lateral surface of the clutch moves in a direction perpendicular to a longitudinal axis of the multi-function sub to suspend a transfer of the torque from the rotating top drive to the tubular; and enabling the tubular to move relative to the top drive in a direction along the longitudinal axis of the multi-function sub via a compensator disposed in the multi-function sub.

* * * * *